US007434705B2

(12) United States Patent
Evangelista

(10) Patent No.: US 7,434,705 B2
(45) Date of Patent: Oct. 14, 2008

(54) METHOD AND APPARATUS FOR FILING AND DISPENSING A LIQUID FROM A CONTAINER

(75) Inventor: Ricardo Enzo Evangelista, Davie, FL (US)

(73) Assignee: M.E.B. Import Export, Corp., Hialeah, FL (US)

( * ) Notice: Subject to any disclaimer, the term of this patent is extended or adjusted under 35 U.S.C. 154(b) by 328 days.

(21) Appl. No.: 11/182,474

(22) Filed: Jul. 15, 2005

(65) Prior Publication Data

US 2007/0012722 A1 Jan. 18, 2007

(51) Int. Cl.
*B65D 35/56* (2006.01)

(52) U.S. Cl. ..... 222/105; 220/495.01

(58) Field of Classification Search ..... 222/95, 222/105, 143, 185.1, 83, 183, 535; 220/495.01, 220/495.03, 601, 605, 614, 661, 4.04, 4.05, 220/4.09

See application file for complete search history.

(56) References Cited

U.S. PATENT DOCUMENTS

| | | | | |
|---|---|---|---|---|
| 3,696,969 | A * | 10/1972 | De Van et al. | 222/105 |
| 3,977,569 | A | 8/1976 | Scholle | |
| 4,105,139 | A | 8/1978 | Scholle | |
| 4,460,221 | A | 7/1984 | Dimino | |
| 4,516,693 | A | 5/1985 | Gaston | |
| RE32,354 | E | 2/1987 | Savage | |
| 5,174,461 | A | 12/1992 | Sullivan | |
| 5,361,906 | A * | 11/1994 | Sterett | 206/509 |
| 5,373,872 | A | 12/1994 | Mueller | |
| 5,449,027 | A | 9/1995 | Mueller | |
| 6,131,767 | A * | 10/2000 | Savage et al. | 222/1 |
| 6,561,386 | B1 * | 5/2003 | Martens | 222/105 |
| 6,772,912 | B1 * | 8/2004 | Schall et al. | 222/143 |
| 2005/0051575 | A1 * | 3/2005 | Durivage | 222/143 |

* cited by examiner

*Primary Examiner*—Lien T Ngo
(74) *Attorney, Agent, or Firm*—Armstrong Teasdale LLP

(57) ABSTRACT

A container including a first end, a second end, and a body extending therebetween and a closure member removably coupled to the first end, wherein the closure member includes a first engagement member. The container also includes a second engagement member removably coupled to the closure member and the first end and a plurality of support members configured to engage a body of a second container. A retaining member is removably coupled to the first end and to the closure member such that the retaining member extends through the first end and engages a recess within the closure member.

28 Claims, 8 Drawing Sheets

METHOD AND APPARATUS FOR FILING AND DISPENSING A LIQUID FROM A CONTAINER

BACKGROUND OF THE INVENTION

This invention relates generally to a liquid container, and more particularly, to a method and apparatus for filling and dispensing a liquid from a container.

Containers, specifically, wine containers, are generally known and may be constructed from a variety of materials and formed into a variety of shapes and sizes. For example, a wine-filled, plastic bladder or bag may be positioned within a box. Generally, the box is rectangular in shape and fabricated from cardboard and designed to protect the plastic wine bag. More specifically, some known boxed wines have a perforated opening sized to temporarily receive a wine dispensing spout therethrough while maintaining the plastic wine bag inside the box. However, because the opening is sized to receive only the dispensing spout therethrough, the wine bag is not removable and the entire box of wine must be discarded after use.

Although boxes generally protect wine bags from puncture and allow for portability of the wine, boxes constructed of cardboard may decrease the shelf life of the wine due to exposure to atmospheric temperature fluctuations and may limit the ability to stack multiple boxes on top of one another.

BRIEF DESCRIPTION OF THE INVENTION

In one aspect, a container is provided. The container includes a first end, a second end, a body extending therebetween, and a closure member removably coupled to the first end, wherein the closure member includes a first engagement member. The container also includes a second engagement member removably coupled to the closure member and the first end and a plurality of support members configured to engage a body of a second container. A retaining member is removably coupled to the first end and to the closure member such that the retaining member extends through the first end and engages a recess within the closure member.

In another aspect, a method of stacking containers is provided. The method includes positioning a first container on top of a second container wherein each container includes an open first end, a closed second end, and a barrel-shaped body extending therebetween. Each body includes at least one support member defined thereon and extending outwardly from a bottom portion of each body. Each body further includes at least one recess defined therein and extending inwardly from a top portion of each body, wherein a first support member from the first container is substantially aligned with a recess of the second container. The method also includes inserting the first support member of the first container into the recess of the second container such that the containers are secured to one another.

In a further aspect, a method of dispensing wine is provided. The method includes providing a wine filled flexible bag including a dispensing spout and a body and providing a container wherein the container includes an open first end, a closed second end, and a barrel-shaped body extending therebetween. The container also includes a closure member removably coupled to the first end, wherein the closure member includes a first arcuate engagement member sized to receive the dispensing spout therein. The container further includes a second arcuate engagement member removably coupled to the closure member and the first end, and a fastener configured to extend through the container body and into the closure member. The method also includes coupling the wine spout between the first and second engagement members such that the wine bag body is sealed within the container body and from the atmosphere.

DETAILED DESCRIPTION OF THE INVENTION

Figure 1:
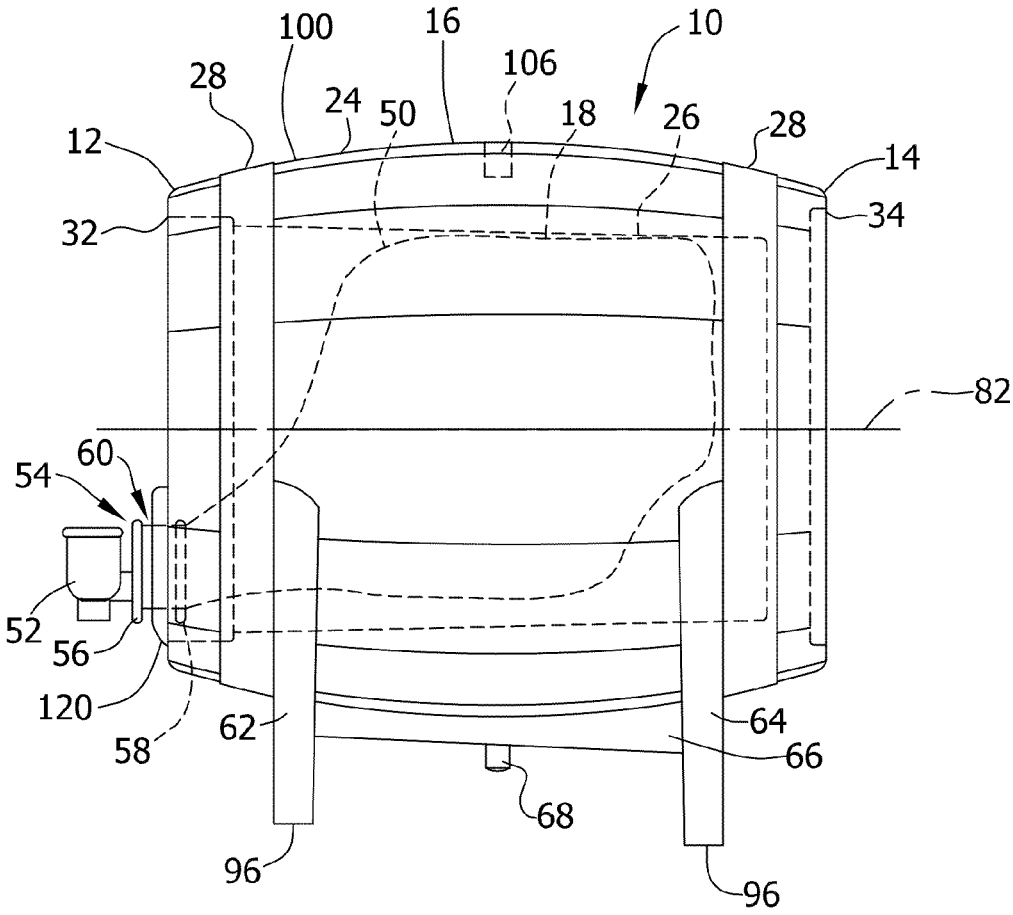
FIG. 1 is a side view of an exemplary embodiment of a container.
Figure 2:
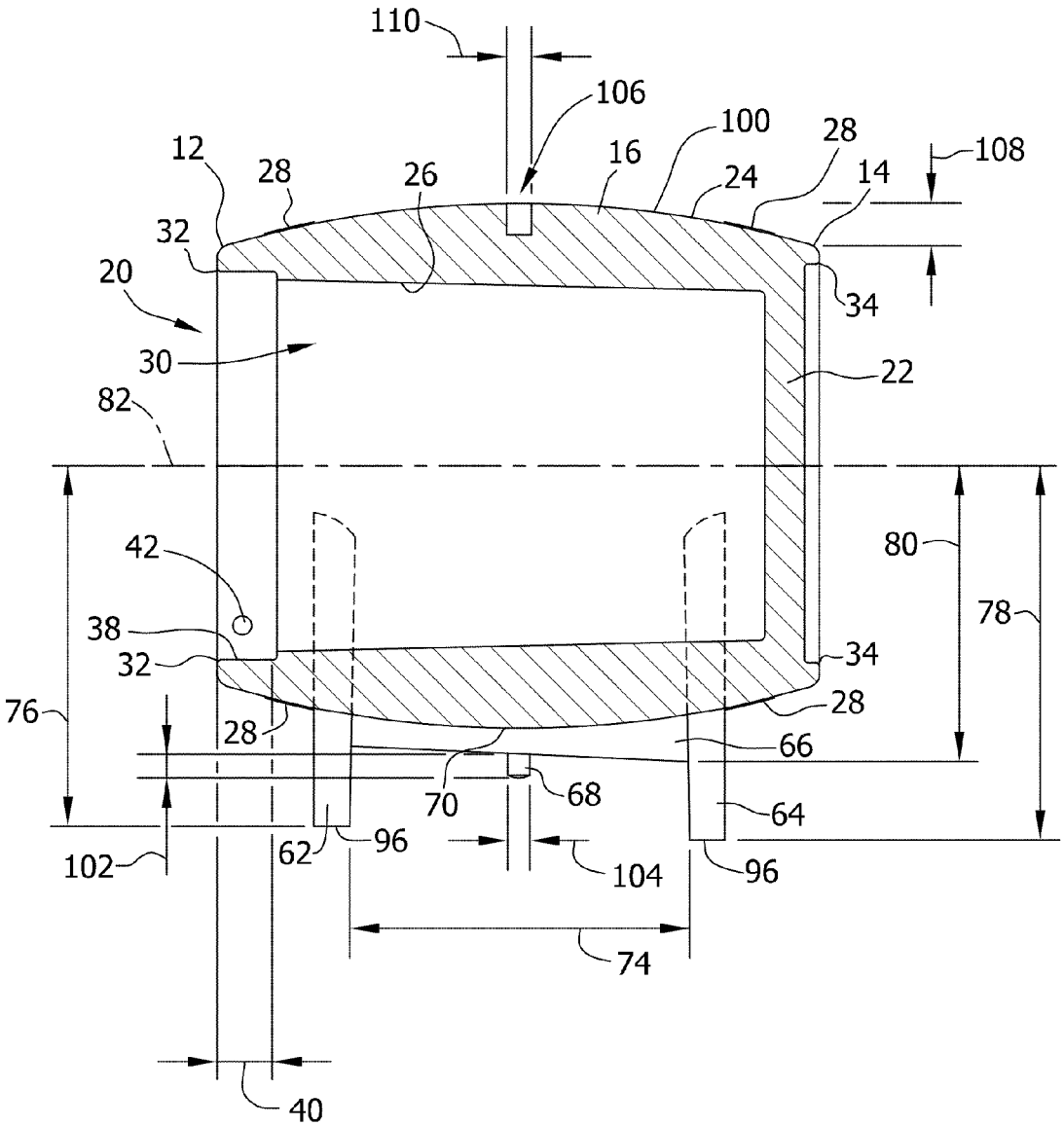
FIG. 2 is a cross-sectional view of the container shown in FIG. 1.
Figure 3:
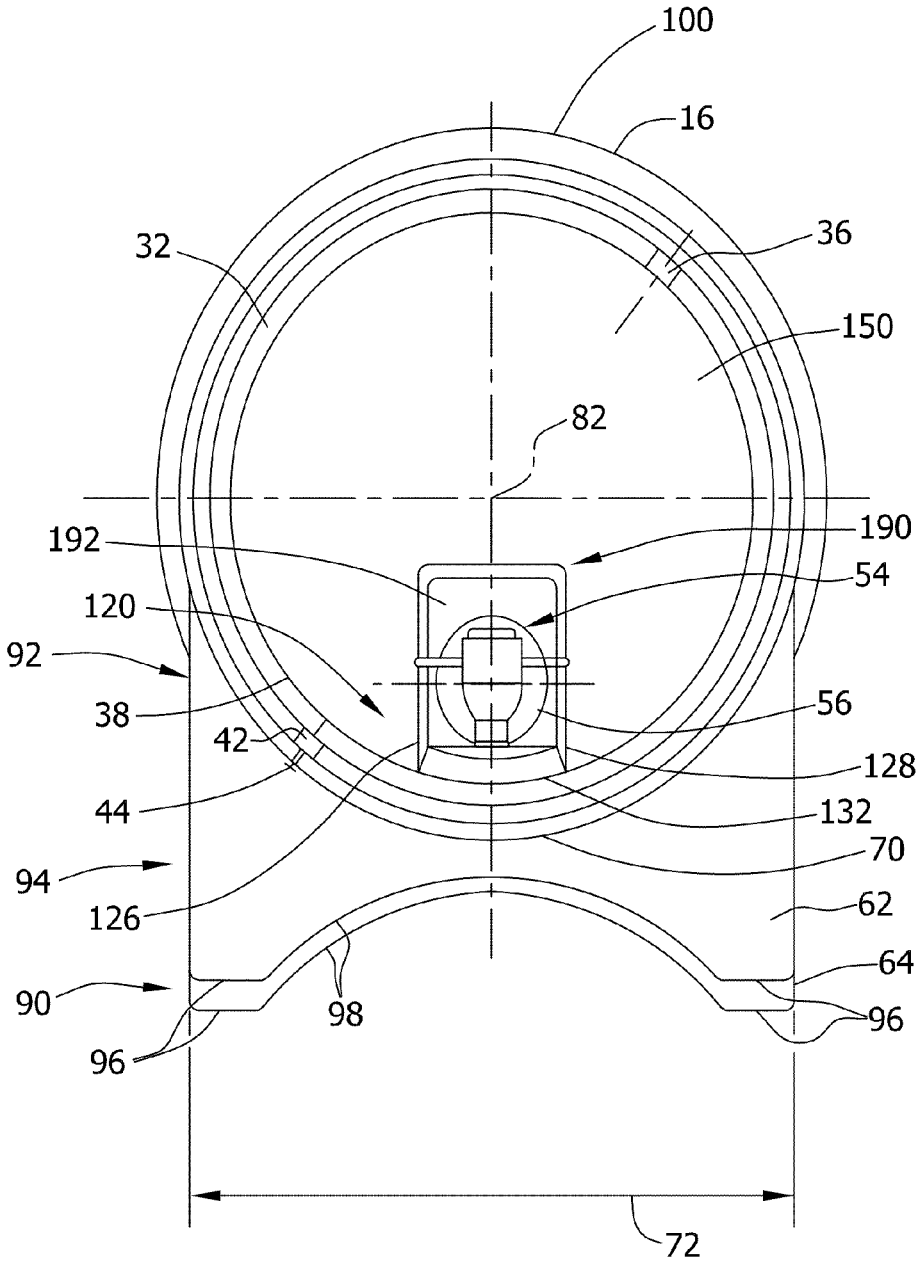
FIG. 3 is a front view of the container shown in FIG. 1.

FIG. 1 is a side view of a container 10, FIG. 2 is a cross-sectional view of container 10, and FIG. 3 is front view of container 10. In an exemplary embodiment, container 10 includes a first end 12, a second end 14, and a body 16 extending therebetween. Container 10 is configured to facilitate accommodating a fluid-filled, flexible bladder or bag 18.

Container 10 may have various sizes and shapes. In the exemplary embodiment, container 10 is sized to accommodate a four liter bag or 1.22 gallons of wine. In alternative embodiments, container 10 may be larger or smaller than the above indicated size, depending upon the particular application or size of bag 18.

In the exemplary embodiment, container 10 is barrel-shaped. In alternative embodiments, container 10 may have any other shape, such as, but not limited to, a rectangular shape, a square shape, or a non-orthogonal shape, such as, a cylindrical shape or a curvilinear shape.

In the exemplary embodiment, container 10 is fabricated from BAYDUR® and/or DESMODUR® both available from Bayer Material Science LLC, Pittsburgh, Pa. In another embodiment, container 10 is fabricated from a polypropylene material. In alternative embodiments, container 10 is fabricated from any shape-retentive, break-resistant, thermal polymer material, such as, but not limited to, a high density polyurethane material, a polyethylene material, and an isocynate material that enables container 10 to function as described herein. In the exemplary embodiment, container 10 is fabricated by a manual molding process. In another embodiment, container 10 is fabricated by an automatic molding process. In alternative embodiments, container 10 is fabricated by any other process, such as, but not limited to, a forming process, a milling process, or a grinding process.

In the exemplary embodiment, first end 12 has a circular opening 20 and is sized to receive bag 18 therethrough. In alternative embodiments, opening 20 may have any other shape, such as, but not limited to, a square shape, an oval shape, or a curvilinear shape. In one embodiment, second end 14 is closed by an integral, imperforate wall 22 that is substantially perpendicular to body 16. In another embodiment, wall 22 is a removable wall coupled to second end 14.

Body 16 has an outer surface 24 and an inner surface 26. In the exemplary embodiment, outer surface 24 is configured to resemble the appearance of a conventional barrel in aspects, such as, texture, design, and color. In the exemplary embodiment, outer surface 24 is molded with a simulated wood grain barrel stave pattern and a pair of simulated metal hoops 28 extend circumferentially about outer surface 24.

Inner surface 26 defines a cavity 30. In the exemplary embodiment, cavity 30 is substantially cylindrical. In alternative embodiments, cavity 30 is shaped to accommodate bag 18 therein. First end 12 includes an integrally formed first annular flange or lip 32. Second end 14 includes a second annular lip 34 formed integrally at a junction of second end 14 and wall 22. In the exemplary embodiment, first annular lip 32 includes an integrally molded, outwardly extending recess 36 and a seating ledge 38 extending circumferentially about first annular lip 32. Ledge 38 has a width 40. In one embodiment, width 40 is approximately twenty-two millimeters.

In the exemplary embodiment, first annular lip 32 includes an integrally formed aperture 42 extending between outer surface 24 and inner surface 26 configured to receive a retaining member 44 therethrough. In another embodiment, aperture 42 is a slot configured to frictionally receive retaining member 44. In yet another embodiment, aperture 42 is a threaded aperture configured to receive a threaded retaining member 44 such as a screw fastener.

Bag 18 is configured to continually collapse as a pre-filled liquid is dispensed therefrom. In one embodiment, bag 18 is a collapsible wine bag. In another embodiment, bag 18 is a "bag-in-a box" wine bladder. In alternative embodiments, bag 18 may be any other type of bag that enables container 10 to function as described herein. In the exemplary embodiment, bag 18 has a deformable body 50 coupled to a non-deformable spout 52. Spout 52 facilitates dispensing wine and securing wine bag 18 within container 10. Spout 52 includes a collar 54 defined by a first annular ring 56, a second annular ring 58, and a groove 60 extending therebetween.

In the exemplary embodiment, container 10 includes a first support member 62, a second support member 64, a third support member 66, and a fourth support member 68. In the exemplary embodiment, each support member 62, 64, 66, and 68, is solid and extends radially from a lower portion 70 of body 16. In another embodiment, support members 62, 64, 66, and 68 are hollow. In the exemplary embodiment, support members 62, 64, 66, and 68 are integral with body 16. In alternative embodiments, support members 62, 64, 66, and 68 are coupled to lower portion 70.

First support member 62 and second support member 64 are substantially parallel to one another, and third support member 66 extends between support members 62 and 64. As such, first and second support members 62 and 64 are substantially perpendicular to third support member 66. Support members 62 and 64 have a first length 72, and support member 66 has a second length 74. In the exemplary embodiment, length 72 is different than length 74. Alternatively, lengths 72 and 74 may be selected to be any length. In one embodiment, first length 72 is approximately 202 millimeters and second length 74 is approximately 179 millimeters. In alternative embodiments, first length 72 and second length 74 may be longer or shorter than the above indicated lengths depending upon the particular container.

Additionally, first support member 62 has a first height 76, second support member 64 has a second height 78, and third support member 66 has a third height 80 measured from a center axis 82. In the exemplary embodiment, first height 76 is less than second height 78 such that container 10 slopes toward first end 12 facilitating the flow of wine towards wine bag spout 52. Third height 80 is less than first height 76. Alternatively, heights 76, 78, and 80 may be selected to be any height. In one embodiment, first height 76 is approximately 152 millimeters, second height 78 is approximately 161 millimeters, and third height 80 is between approximately 125 millimeters and approximately 131 millimeters. In alternative embodiments, heights 76, 78, and 80 may be longer or shorter than the above indicated heights depending upon the particular container.

First and second support members 62 and 64 each include a first end 90, a second end 92, and a body 94 extending therebetween. In the exemplary embodiment, each first end 90 includes a linear portion 96 and an arcuate portion 98. Specifically, each first end 90 is configured to engage both a flat surface (not shown) at linear portion 96 and/or curved top portion 100 of another container 10 at arcuate portion 98. In the exemplary embodiment, arcuate portion 98 has a substantially similar curve shape as body 16.

In the exemplary embodiment, fourth support member 68 is cylindrical shaped. In the exemplary embodiment, fourth support member 68 extends a distance 102, has a diameter 104, and is configured to matingly couple with a recess 106 in top portion 100 of body 16 of a second container (not shown in FIGS. 1-3) such that two containers 10 are stackable upon each other in a fixed relationship with each other. In one embodiment, distance 102 is approximately 12 millimeters and diameter 104 is approximately 10 millimeters. In the exemplary embodiment, recess 106 is cylindrical shaped and sized to frictionally mate with fourth support member 68. In the exemplary embodiment, recess 106 has a depth 108 and a diameter 110 and is positioned at an apex of top portion 100.

Figure 4:
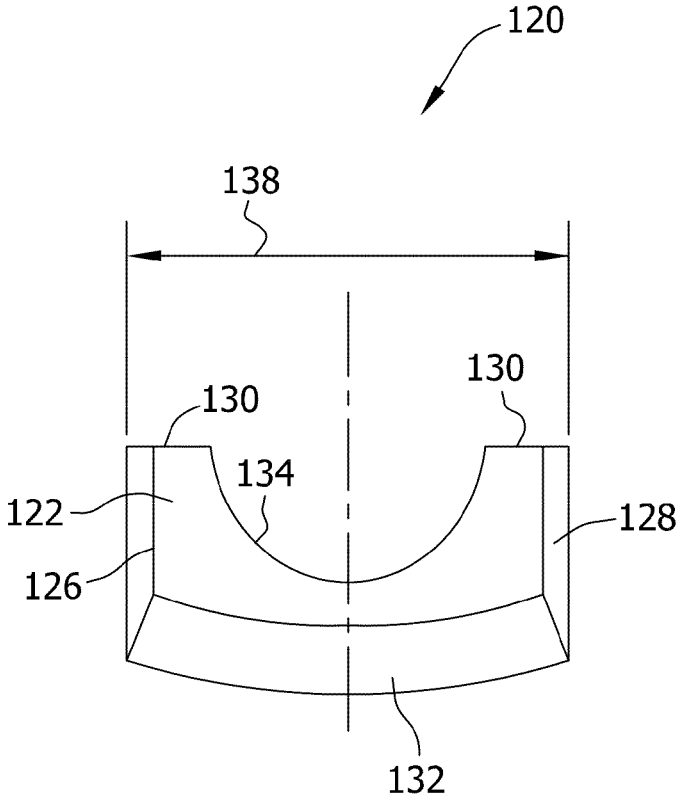
FIG. 4 is a front view of an exemplary embodiment of an engagement member.
Figure 5:
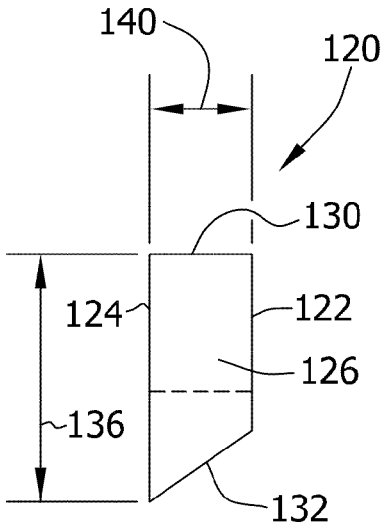
FIG. 5 is a cross-sectional view of the engagement member shown in FIG. 4.

FIG. 4 is a front view of an exemplary embodiment of an engagement member 120. FIG. 5 is a cross-sectional view of engagement member shown 120 in FIG. 4. In the exemplary embodiment, engagement member 120 is curvilinear in shape. In alternative embodiments, engagement member 120 may have any shape that enables engagement member 120 to function as described herein. In the exemplary embodiment, engagement member 120 is solid and includes an outer surface 122 and an inner surface 124. In another embodiment, engagement member 120 is hollow. In the exemplary embodiment, outer surface 122 is configured to resemble the appearance of a conventional barrel in all aspects to include, but not limited to, texture, design, and color. In the exemplary embodiment, outer surface 122 is molded with a simulated wood grain barrel stave pattern.

In the exemplary embodiment, engagement member 120 includes a first sidewall 126, a second sidewall 128, a third sidewall 130, and a fourth sidewall 132. First sidewall 126 and second sidewall 128 are substantially parallel to one another, third sidewall 130 has an arcuate portion 134, and fourth sidewall 132 is arcuate. Specifically, arcuate portion 134 is substantially the same shape as spout collar 54 and configured to couple thereto and fourth sidewall 132 is substantially the same shape as first annular lip 32 and configured to couple thereto such that engagement member 120 facilitates sealing cavity 30 from the outside atmosphere. In the exemplary embodiment, sidewalls 126, 128, and 132 are tapered towards outer surface 122 and sidewall 130 and arcuate portion 134 are substantially perpendicular to outer surface 122.

Engagement member 120 has a first length 136 and a second length 138. In the exemplary embodiment, length 136 is different than length 138. Alternatively, lengths 136 and 138 may be selected to be any length. Additionally, engagement member 120 has a uniform height 140. In one embodiment, first length 136 is approximately 30.5 millimeters and second length 138 is approximately 52 millimeters. In one embodiment, height 140 is approximately 12 millimeters. In alternative embodiments, first length 136, second length 138, and/or height 140 may be longer or shorter than the above indicated lengths and height, depending upon the particular container.

Figure 6:
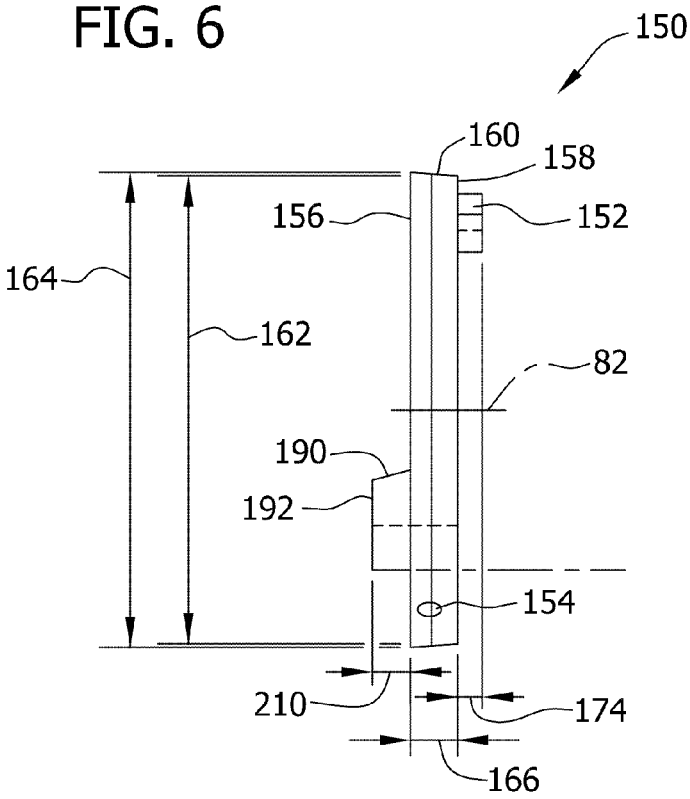
FIG. 6 is a cross-sectional view of an exemplary embodiment of a closure member.
Figure 7:
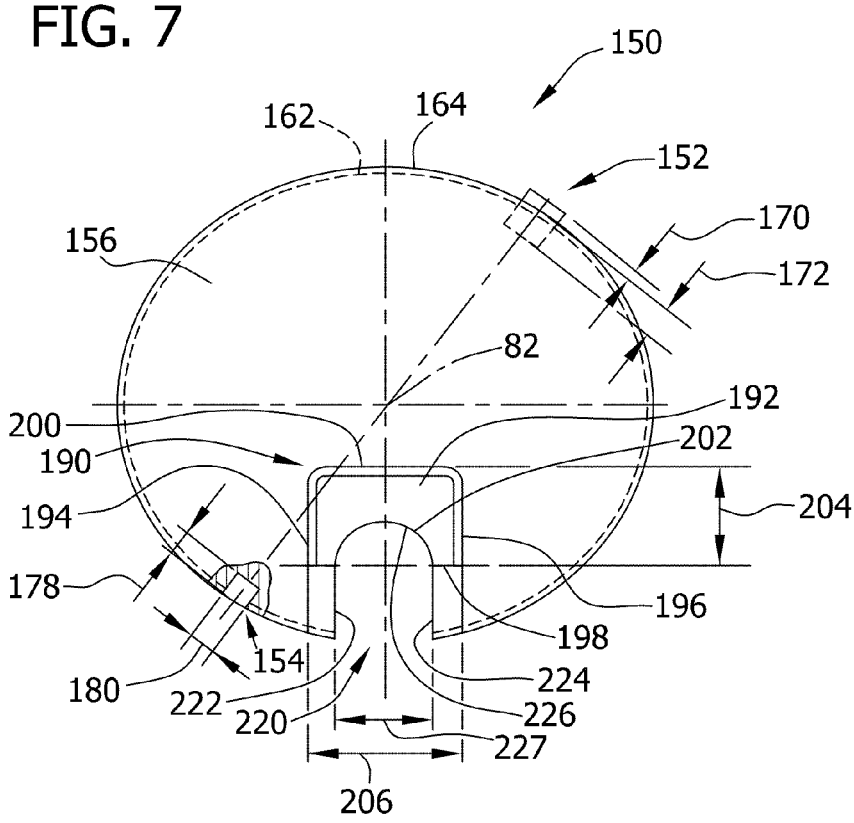
FIG. 7 is a front view of the closure member shown in FIG. 6.

FIG. 6 is a cross-sectional view of an exemplary embodiment of a closure member 150. FIG. 7 is a front view of closure member 150. Closure member 150 is removably coupled to first end 12 by an alignment member 152 and a recess 154. In the exemplary embodiment, closure member 150 is circular in shape. In alternative embodiments, closure member 150 may have any other shape, such as, but not limited to, a square shape, an oval shape, or a curvilinear shape. Specifically, closure member 150 has the same shape as opening 20.

In the exemplary embodiment, closure member 150 includes an outer surface 156, an inner surface 158, and a sidewall 160 extending therebetween. Outer surface 156 and inner surface 158 are substantially parallel to one another. In the exemplary embodiment, sidewall 160 tapers towards inner surface 158. In the exemplary embodiment, outer surface 156 is configured to resemble the appearance of a conventional barrel in aspects such as texture, design, and color. In the exemplary embodiment, outer surface 156 is molded with a simulated wood grain barrel stave pattern.

Closure member 150 has an inner diameter 162, an outer diameter 164, and sidewall 160 has a width 166. In the exemplary embodiment, inner diameter 162 is less than outer diameter 164 and sidewall width 166 is less than lip ledge width 40. In alternative embodiments, diameters 162 and 164 are equal and widths 166 and 40 are equal. In one embodiment, inner diameter 162 is approximately 176 millimeters, outer diameter 164 is approximately 177 millimeters, and width 166 is 16 millimeters. In alternative embodiments, inner diameter 162, outer diameter 164, and/or width 166 may be longer or shorter than the above indicated length and width, depending upon the particular container. Sidewall 160 is configured to couple with first annular lip 32 such that closure member 150 facilitates sealing cavity 30 from the outside atmosphere.

Alignment member 152 is configured to engage first lip recess 36 when closure member 150 is coupled to first end 12 such that closure member 150 is secured in a predetermined position when alignment member 152 is inserted within recess 36. In the exemplary embodiment, alignment member 152 is substantially rectangular in shape. In alternative embodiments, alignment member 152 may have any other shape, such as, but not limited to, a square shape, or a non-orthogonal shape, such as, a cylindrical shape or a curvilinear shape. Alignment member 152 extends outwardly a first distance 170 from sidewall 160, extends inwardly a second distance 172 from sidewall 160, and extends outwardly a third distance 174 from inner surface 158. In one embodiment, first distance 170 is approximately 6 millimeters, second distance 172 is approximately 10 millimeters, third distance 174 is approximately seven millimeters. In the exemplary embodiment, recess 36 (not shown in FIGS. 4 and 5) is positioned directly opposite recess 154. In alternative embodiments, closure member 150 includes a plurality of alignment members 152 that are positioned circumferentially about sidewall 160 and configured to couple to a plurality of recesses 36.

Recess 154 is configured to receive retaining member 44 therein. In the exemplary embodiment, recess 154 is substantially cylindrical in shape. In one embodiment, recess 154 is threaded. In alternative embodiments, recess 154 may have any other shape, such as, but not limited to, a rectangular shape, a square shape, or a non-orthogonal shape, such as, a curvilinear shape. Recess 154 extends inwardly a distance 178 from sidewall 160 and has a diameter 180. In one embodiment, distance 178 is approximately 10 millimeters and diameter 180 is approximately 8 millimeters. In the exemplary embodiment, recess 154 is sized to receive retaining member 44 therein. In alternative embodiments, recess 154 is any recess that allows closure member 150 to be removably coupled to first end 12.

Closure member 150 further includes an engagement member 190 configured to couple with engagement member 120 about spout collar 54. In the exemplary embodiment, engagement member 190 is curvilinear in shape. In alternative embodiments, engagement member 190 may have any shape that enables engagement member 190 to function as described herein.

In the exemplary embodiment, engagement member 190 is solid and includes an outer surface 192. In another embodiment, engagement member 190 is hollow. In the exemplary embodiment, outer surface 192 is configured to resemble the appearance of a conventional barrel in all aspects including texture, design, and color. In the exemplary embodiment, outer surface 192 is molded with a simulated wood grain barrel stave pattern. In the exemplary embodiment, engagement member 190 is integral with closure member 150 and includes a first sidewall 194, a second sidewall 196, a third sidewall 198, and a fourth sidewall 200. First sidewall 194 and second sidewall 196 are substantially parallel to one another, third sidewall 198 has an arcuate portion 202. First and second sidewalls 194 and 196 are substantially perpendicular to fourth sidewall 200. Sidewall 198 and arcuate portion 202 are substantially perpendicular to outer surface 192. In the exemplary embodiment, sidewalls 194, 196, and 200 are tapered towards outer surface 192. Arcuate portion 202 is substantially the same shape as spout collar 54 and is configured to couple thereto such that engagement member 190 facilitates sealing cavity 30 from the outside atmosphere. Additionally, arcuate portion 134 (shown in FIG. 4) and arcuate portion 202 have the same shape.

Sidewalls 194 and 196 have a first length 204, and fourth sidewall 200 has a second length 206. In the exemplary embodiment, length 204 is different than length 206. Additionally, in the exemplary embodiment, length 206 is equal to length 138 and a height 210 is equal to height 140. Alternatively, lengths 204 and 206 may be selected to be any length. Additionally, engagement member 190 has a uniform height 210. In one embodiment, first length 204 is approximately 36 millimeters, second length 206 is approximately 52 millimeters, and height 210 is approximately 12 millimeters. In alternative embodiments, first length 204, second length 206, and/or height 210 may be longer or shorter than the above indicated length and height, depending upon the particular container.

Closure member 150 also includes an aperture 220 extending inwardly from sidewall 160 towards center axis 82. Aperture 220 includes a first inner wall 222, a second inner wall 224, and an arcuate portion 226 extending therebetween. Arcuate portion 226 is at least partially circumscribed by arcuate portion 202 of engagement member 190. Arcuate portion 226 is sized to receive pour spout collar 54 therein. Inner walls 222 and 224 are sized to receive engagement member 120 therein. In one embodiment, aperture 220 has a length 227 and is approximately 33 millimeters.

Engagement member 120 and closure member 150 are configured to couple together and facilitate sealing wine bag 18 within container 10. Specifically, wine bag 18 may be inserted inside container 10 to dispense wine and upon when empty, removed and replaced by a full wine bag 18. During insertion operations, container 10 is rotated vertically such that it rests on second end 14 and first end 12 is pointed up. Retaining member 44 is removed from aperture 42 and recess 154. In the exemplary embodiment, closure member 150 is removed by lifting upwards and at an angle such that alignment member 152 disengages recess 36 and both closure member 150 and engagement member 120 disengage from lip 32. In the exemplary embodiment, engagement member 120 is removed from closure member 150 by sliding engagement member 120 out of aperture 220 towards sidewall 160. Once engagement member 120 is removed from closure member 150 a full wine bag 18 is ready for insertion. Holding full wine bag 18 by collar 54, wine bag 18 is inserted through aperture 220 towards engagement member 190. Specifically, collar annular ring 56 slides along closure member outer surface 156 along inner walls 222 and 224, while, simultaneously, annular ring 58 slides along inner surface 158 along inner walls 222 and 224. Wine bag 18 is aligned such that spout 52 is substantially parallel with aperture 220. Engagement member 120 is inserted into aperture 220 such that collar 54 is positioned adjacent and coupled to engagement members 120 and 190 and spout groove 60 is adjacent arcuate portions 134 and 226, respectively.

Wine bag body 50 is then placed into cavity 30 and closure member 150 is positioned in place. Specifically, alignment member 152 is inserted into lip recess 36. Finally, retaining member 44 is inserted through aperture 42 and into recess 154. Upon tightening retaining member 44, wine bag 18 is sealed within container 10. Removal of empty bag requires loosing and removing retaining member 44, tilting out and removing closure member 150, disengaging engagement member 120, and discarding empty wine bag 18.

Figure 8:
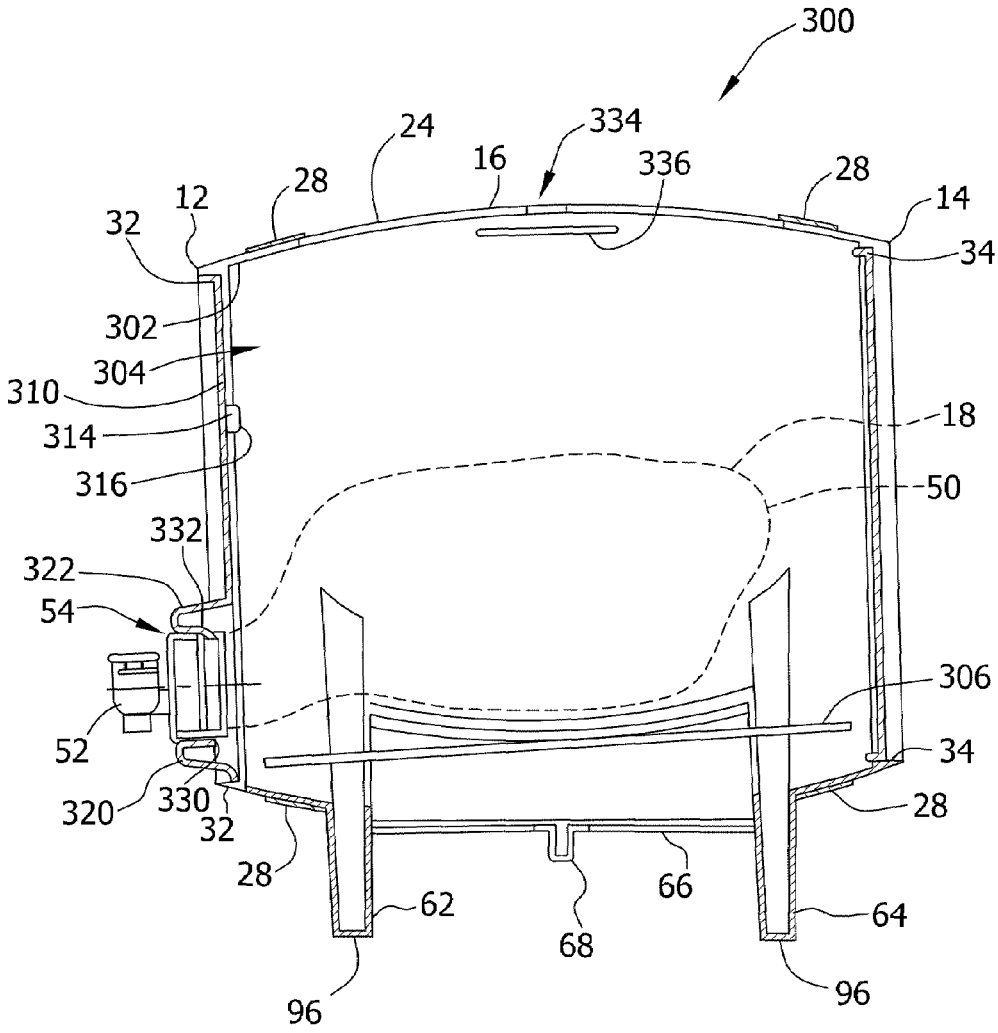
FIG. 8 is cross-sectional view of a second embodiment of the container shown in FIG. 1.
Figure 9:
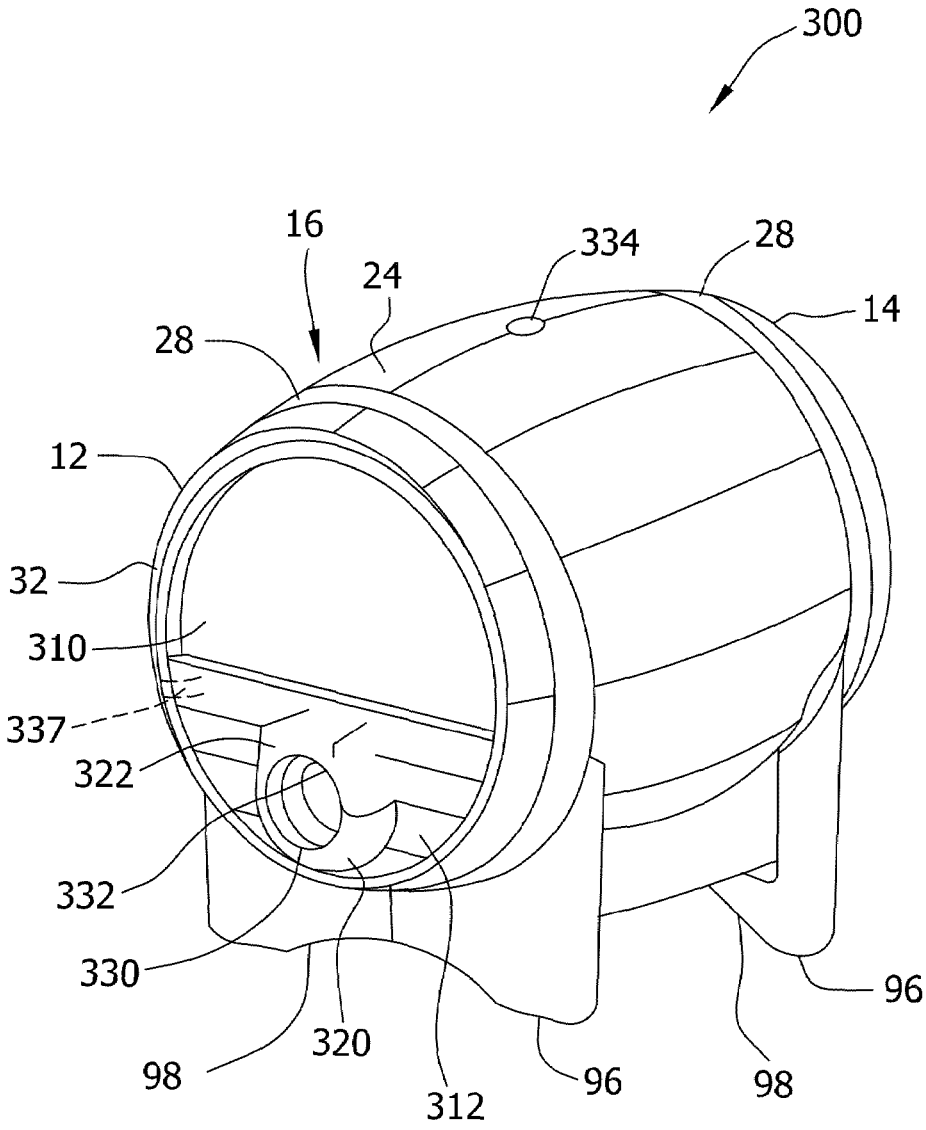
FIG. 9 is perspective view of the container shown in FIG. 8.

FIG. 8 is a cross-sectional view of an alternative embodiment of container 300. FIG. 9 is a perspective view of container 300. FIGS. 8 and 9 have been labeled such that like features from FIGS. 1-7 are like numbered and new features have different numbers. In the exemplary embodiment, container 300 includes a first end 12, a second end 14, and a body 16 extending therebetween. Container 300 is configured to facilitate accommodating a wine-filled, flexible bladder or bag 18.

In the exemplary embodiment, container 300 is fabricated from a polypropylene material using an automatic molding process. In alternative embodiments, container 300 is fabricated by any other process, such as, but not limited to, a forming process, a milling process, or a grinding process.

Body 16 has an inner surface 302 defining a cavity 304. In the exemplary embodiment, cavity 304 is substantially curvilinear. In alternative embodiments, cavity 304 is shaped to accommodate bag 18 therein. Cavity 304 includes a bag ledge 306 tilted to allow wine to escape wine bag 18. Specifically, bag ledge 306 is sized to support wine bag 18 and is tilted towards first end 12 at an angle that facilitates increasing the flow of wine from wine bag 18. Container 300 includes first annular lip 32 formed integrally at first end 12 and second annular lip 34 formed integrally at second end 14. Container 300 includes a first closure member 310 and a second closure member 312 removably coupled to first end 12. Closure member 310 is removably coupled to first end 12 by a plurality of attachments 314 configured to engage a plurality of recesses 316 in first annular lip 32. Closure member 310 is configured to circumferentially couple wine bag collar 54 between a first engagement member 320 and a second engagement member 322. In one embodiment, closure member 310 is hinged such that first engagement member 320 and second engagement member 322 are matingly coupled.

Engagement members 320 and 322 each have an annular ring 330 and 332, respectively. Annular rings 330 and 332 are configured to circumferentially engage wine spout collar 54 such that cavity 304 is sealed from the outside atmosphere. Specifically, each of rings 330 and 332 partially circumscribe wine spout collar 54 between wine collar rings 56 and 58.

In the exemplary embodiment, container 300 also includes support members 62, 64, 66, and 68 which are hollow. Support members 62 and 64 include linear portions 96 and arcuate portions 98. Fourth support member 68 is configured to couple to an aperture 334. In the exemplary embodiment, aperture 334 is circular and positioned at the apex of body 16. A wine guard ledge 336 is positioned between aperture 334 and cavity 304 such that wine bag 18 is protected from puncture or damage.

In the exemplary embodiment, container 300 includes a retaining member 337 fixedly coupled through first end 12 and engages a recess (not shown) within second closure member 312. In one embodiment, retaining member 337 is coupled to first end 12 by at least one of a fastener, a tether, and a wire.

Figure 10:
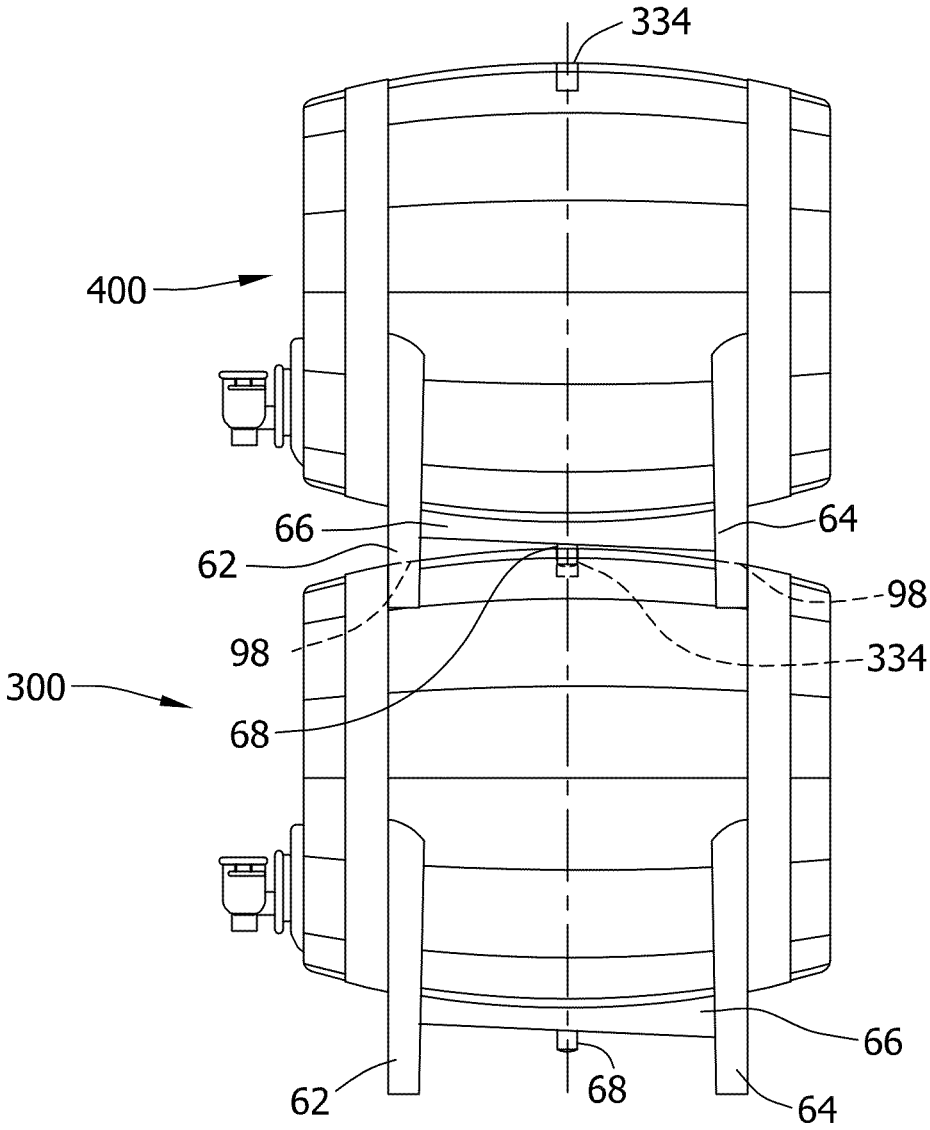
FIG. 10 is a side view of two containers coupled together.

FIG. 10 is side view of a pair of containers 300 coupled to and stacked upon one another. In the exemplary embodiment, container 300 is used as an example, but container 10 is configured to stack in the same manner. A first container 300 is positioned on a flat surface (not shown) such that support member linear portions 96 engage the flat surface. A second container 400 is positioned on top of first container 300 such that second container support member 68 engages and couples with first container aperture 334. Simultaneously, second container support members 62 and 64 arcuate portions 98 engage the top of second container body 16. The combination of support members 62, 64, and 68 facilitate stacking multiple containers on top of each other.

Containers 10 and 300 facilitate increasing the shelf life of the wine by reducing exposure to atmospheric temperature fluctuations and increasing the ability to stack multiple containers on top of one another. Furthermore, insertion and removal of engagement member 120 and closure member 150 facilitates rapid exchange of wine bags 18.

While the invention has been described in terms of various specific embodiments, those skilled in the art will recognize that the invention can be practiced with modification within the spirit and scope of the claims.

What is claimed is:

1. A container comprising:

an open first end, a closed second end, and a body extending therebetween, said body comprising a cavity therein;

a closure member removably coupled to said first end, said closure member including a first engagement member;

a second engagement member removably coupled to said closure member and said first end;

a plurality of support members configured to engage a body of a second container;

a retaining member removably coupled to said first end and to said closure member such that said retaining member extends through said first end and engages a recess within said closure member; and a liner removably housed within said body cavity, said liner comprising a spout at least partially engaged by said first and said second engagement members.

2. A container in accordance with claim 1 wherein said liner comprises a fluid filled flexible bag.

3. A container in accordance with claim 1 wherein said closure member includes an aperture configured to receive at least a portion of said second engagement member therein, said first engagement member extending a distance substantially perpendicularly from said closure member and configured to couple to said second engagement member.

4. A container in accordance with claim 1 wherein said closure member includes an alignment member and a recess, said alignment member configured to engage said first end such that said closure member is secured to said first end in a predetermined position, said recess opposite said alignment member.

5. A container in accordance with claim 1 wherein said first end includes a first annular lip and a second annular lip, each of said lips extending a distance circumferentially about said body such that each of said first and second ends are recessed within said body.

6. A container in accordance with claim 5 wherein said first annular lip includes at least one recess configured to receive at least a portion of said closure member therein.

7. A container in accordance with claim 1 wherein said plurality of support members includes a first support member extending a first distance substantially perpendicularly from said body, a second support member extending a second distance substantially perpendicularly from said body, said second distance greater than said first distance, said first support member coupled to said second support member by a third support member, said first and second support members each comprising a first end, a second end, and a body extending therebetween, wherein said first end is arcuate and is configured to releasably couple to the second container.

8. A container in accordance with claim 1 wherein said plurality of support members includes a fourth support member extending substantially perpendicularly from said body, said fourth support member comprising a cylindrical body and a substantially flat end, wherein said flat end is configured to releasably couple to the second container.

9. A container in accordance with claim 1 wherein said container is hand molded and fabricated from at least one of a polypropylene material and a polyurethane material.

10. A method of stacking containers, said method comprising:

providing a first container and a second container, each container including a first end, a second end, a top surface, a bottom surface, and a liner removably housed therein, wherein a closure member is removably coupled to the first end and wherein a first engagement member is defined on the closure member and a second engagement member is removably coupled to the closure member and the first end, the liner including a spout at least partially engaged by the first and the second engagement members, each of the first and second containers further including at least one support member extending outwardly from the bottom surface and at least one recess extending inwardly from the top surface;

positioning the first container on top of the second container such that the at least one support member of the first container is substantially aligned with the at least one recess of the second container, the at least one recess of the second container sized to receive therein the at least one support member of the first container; and inserting the at least one support member of the first container into the at least one recess of the second container such that the first and second containers are secured to one another.

11. A method in accordance with claim 10 further comprising coupling a second support member and a third support member of the first container to the top surface of the second container body such that the containers are secured to each other.

12. A method in accordance with claim 11 further comprising providing arcuate portions along a bottom portion of the second and third support members of the first container to facilitate increasing the stability of stacking the first container on top of the second container.

13. A method in accordance with claim 10 further comprising providing flat portions along a bottom portion of a second and a third support member of the second container to facilitate increasing the stacking stability of the second container on a flat surface.

14. A method in accordance with claim 10 wherein said providing a first container and a second container comprises providing each container with a liner including a flexible bag of wine such that at least one of the first and second containers is capable of dispensing wine while the first container is secured to second container.

15. A method of dispensing a liquid, said method comprising:

providing a liquid filled liner including a dispensing spout and a body;

providing a container including an open first end, a closed second end, a body extending therebetween, and a closure member removably coupled to the first end, wherein the closure member includes a first engagement member sized to receive the dispensing spout therein, a second engagement member removably coupled to the closure member and the first end, and a fastener configured to extend through the container body and into the closure member; and coupling the spout between the first and second engagement members such that the spout is at least partially engaged by the first and the second engagement members and such that the liquid filled liner is sealed within the container body and from the atmosphere.

16. A method in accordance with claim 15 wherein said providing a liquid filled liner further comprises providing a liquid filled liner including a spout that includes a first annular ring, a second annular ring, and a groove extending therebetween, the groove configured to be coupled between the first and second engagement members.

17. A method in accordance with claim 16 further comprising inserting the groove into the first engagement member.

18. A method in accordance with claim 16 further comprising coupling the second engagement member about the groove and inserting the liquid filled liner into the container.

19. A method in accordance with claim 18 further comprising coupling the closure member including the liquid filled liner and the engagement members to the container first end and fastening the closure member such that a sealed cavity is defined inside the container body.

20. A method in accordance with claim 19 wherein the liquid is sealed from air and the liquid filled liner is protected by the container during stacking and shipment.

21. A liquid dispensing system comprising:

a liquid filled liner including a dispensing spout;

a unitary container comprising an open first end, a closed second end, and a body extending therebetween, said body comprising an inner surface defining a cavity therein and an integrally formed support ledge extending between said first end and said second end;

a first closure member removably coupled to a second closure member, said first closure member including a first engagement member, said second closure member including a second engagement member, wherein said spout is at least partially engaged by said first and said second engagement members and wherein said first and second closure members are removably coupled to said container first end, said first closure member removably coupled to said first end by a plurality of attachment members;

a plurality of hollow support members extending from said body and configured to engage a body of a second container; and a retaining member extending though said first end and engaging a recess within said first closure member, said retaining member is fixedly coupled to said first end.

22. A system in accordance with claim 21 wherein said liquid filled liner is filled with wine.

23. A system in accordance with claim 21 wherein said first and second engagement members are configured to circumferentially couple to said dispensing spout.

24. A system in accordance with claim 21 wherein said plurality of attachment members are configured to engage a plurality of recesses positioned in said first end.

25. A system in accordance with claim 21 wherein said first closure member is coupled to said second closure member by a hinge.

26. A system in accordance with claim 21 wherein said plurality of support members includes a first support member extending a first distance substantially perpendicularly from said body, a second support member extending a second distance substantially perpendicularly from said body, said second distance greater than said first distance, said first support member coupled to said second support member by a third support member, said first and second support members each comprising a first end, a second end, and a hollow body extending therebetween, each of said first ends is arcuate and is configured to releasably couple to the second container.

27. A system in accordance with claim 21 wherein said plurality of support members comprises a fourth support member extending substantially perpendicularly from said body, said fourth support member comprising a cylindrical, hollow body and a substantially flat end, said flat end configured to releasably couple to the second container.

28. A system in accordance with claim 21 wherein said container is machine molded and fabricated from a polypropylene material.

* * * * *

UNITED STATES PATENT AND TRADEMARK OFFICE

CERTIFICATE OF CORRECTION

PATENT NO. : 7,434,705 B2
APPLICATION NO. : 11/182474
DATED : October 14, 2008
INVENTOR(S) : Evangelista It is certified that error appears in the above-identified patent and that said Letters Patent is hereby corrected as shown below:

Title Page item 54 and Col. 1 line 1
In Title, delete "FILING" and insert therefor --FILLING--.
In Specification, column 6, line 65, delete "wine and upon when" and insert therefor --wine and when--.
In Claim 21, column 11, line 4, delete "though" and insert therefor --through--.

Signed and Sealed this

Third Day of March, 2009

JOHN DOLL
*Acting Director of the United States Patent and Trademark Office*